US010737854B2

(12) United States Patent
Rathgeber et al.

(10) Patent No.: US 10,737,854 B2
(45) Date of Patent: Aug. 11, 2020

(54) SAMPLE SCENT PACKAGING

(71) Applicant: Berlin Packaging, LLC, Chicago, IL (US)

(72) Inventors: Martin Rathgeber, Chicago, IL (US); Brett Niggel, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 183 days.

(21) Appl. No.: 15/966,044

(22) Filed: Apr. 30, 2018

(65) Prior Publication Data

US 2019/0329945 A1 Oct. 31, 2019

(51) Int. Cl.

| | |
|---|---|
| ***B65D 51/16*** | (2006.01) |
| ***B65D 41/04*** | (2006.01) |
| ***B65D 1/02*** | (2006.01) |

(52) U.S. Cl.

CPC ..... *B65D 51/1622* (2013.01); *B65D 1/0246* (2013.01); *B65D 41/04* (2013.01); *B65D 2501/0081* (2013.01)

(58) Field of Classification Search

CPC ..... B65D 51/1622; B65D 51/1661; B65D 51/1688

USPC ..... 215/44

See application file for complete search history.

(56) References Cited

U.S. PATENT DOCUMENTS

| | | | | |
|---|---|---|---|---|
| 3,986,921 | A | 10/1976 | Aichinger | |
| 4,685,580 | A | 8/1987 | Towns et al. | |
| 5,690,241 | A | 11/1997 | Montgomery | |
| 5,899,348 | A * | 5/1999 | Konefal | B65D 50/046 215/209 |
| 6,085,922 | A | 7/2000 | Esser | |
| 6,123,212 | A | 9/2000 | Russell et al. | |
| 6,202,870 | B1 * | 3/2001 | Pearce | B65D 51/1688 215/235 |
| 7,431,877 | B2 | 10/2008 | Druitt | |
| 9,764,877 | B2 | 9/2017 | Tanaka | |
| 2017/0197764 | A1 | 7/2017 | Hein et al. | |

* cited by examiner

*Primary Examiner* — Anthony D Stashick
*Assistant Examiner* — Raven Collins
(74) *Attorney, Agent, or Firm* — Adam K. Sacharoff; Much Shelist, P.C.

(57) ABSTRACT

In one embodiment there is provided a bottle and cap package configuration designed to hold a solid substance and provide an escape path for a scent of the substance. The cap has an internal surface with a mid-section projection to cooperatively rest on an upper ledge of the bottle neck. At least one raised pad is positioned between the upper ledge of the bottle and the underneath side surface of the mid-section projection such that when the cap is positioned on the neck of the bottle, the at least one raised pad creates a ventilation gap permitting a scent of a substance contained in the well of the bottle an escape path between the upper ledge of the bottle and the underneath side surface of the mid-section projection and then around the threads to under the bottom surface edge of the cap.

7 Claims, 8 Drawing Sheets

SAMPLE SCENT PACKAGING

FIELD OF THE INVENTION

The present invention relates to a bottle and cap packaging configured to hold a solid substance, and particularly to a novel threading arrangement configured to permit a consumer to easily obtain a scent of the product held within the bottle.

BACKGROUND OF THE INVENTION

Bottles and Caps are typically designed to seal a product or substance within. Oftentimes if the manufacturer wants to provide the user with the scent of the contents a small scratch pad with the scent will be placed outside of the bottle for the consumer. The present embodiments provide for a unique packaging that allows the consumer to easily obtain the scent of the product within the bottle without the need of a scratch pad.

SUMMARY OF THE INVENTION

In one embodiment of the present invention there is provided a bottle and cap package configured to hold a substance. The bottle has a neck extending from sidewalls that terminate into an upper ledge surrounding an opening into a well. The well is configured to hold a substance, while the neck further includes neck threads. The cap includes a top portion terminating into a downwardly extending cap sidewalls. The cap sidewalls further terminates into a bottom surface edge. The cap sidewalls has an internal surface that has a mid-section projection projecting inwardly to define an underneath side surface configured to cooperatively rest on the upper ledge of the bottle. In addition, the internal surface further includes cap threads below the mid-section projection and extending inwardly to cooperate with the neck threads. At least one raised pad is positioned between the upper ledge of the bottle and the underneath side surface of the mid-section projection of the cap such that when the cap is positioned on the neck of the bottle, the at least one raised pad creates a ventilation gap permitting a scent of a substance contained in the well of the bottle an escape path between the upper ledge of the bottle and the underneath side surface of the mid-section projection and then around the threads to under the bottom surface edge of the cap.

In another embodiment, the neck threads further include an interruption gap dividing the neck threads into thread segments, further providing the scent a path to flow through the interruption gap towards the bottom surface edge of the cap.

In yet other aspects of the invention, the at least one raised pad is positioned onto the underneath side surface of the mid-section projection defined on the cap. Alternatively, the at least one raised pad is positioned onto the upper ledge of the neck defined on the bottle.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
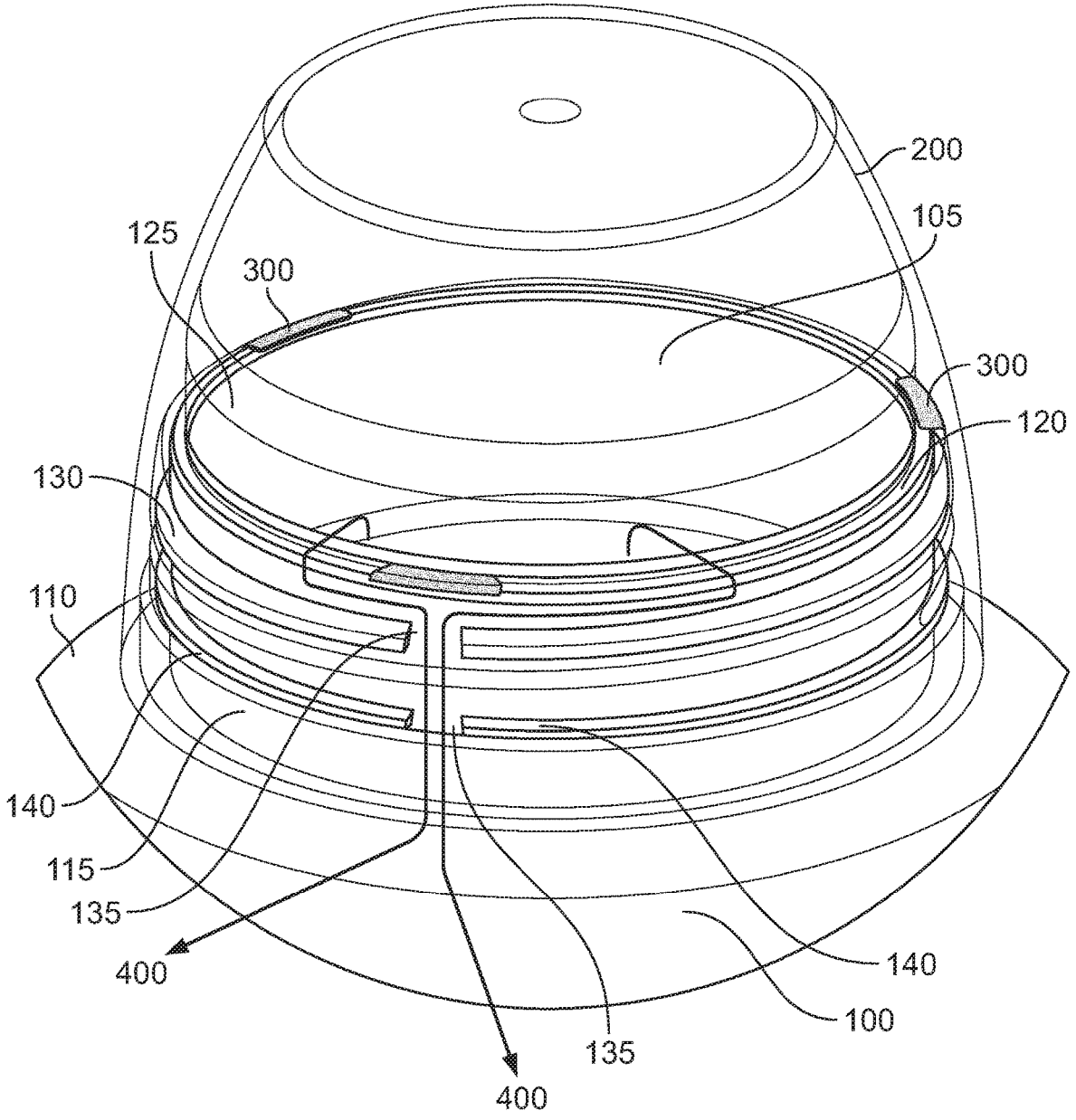
FIG. 1 is a partial perspective view of a top portion of a bottle and a cap in accordance with an embodiment of the invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
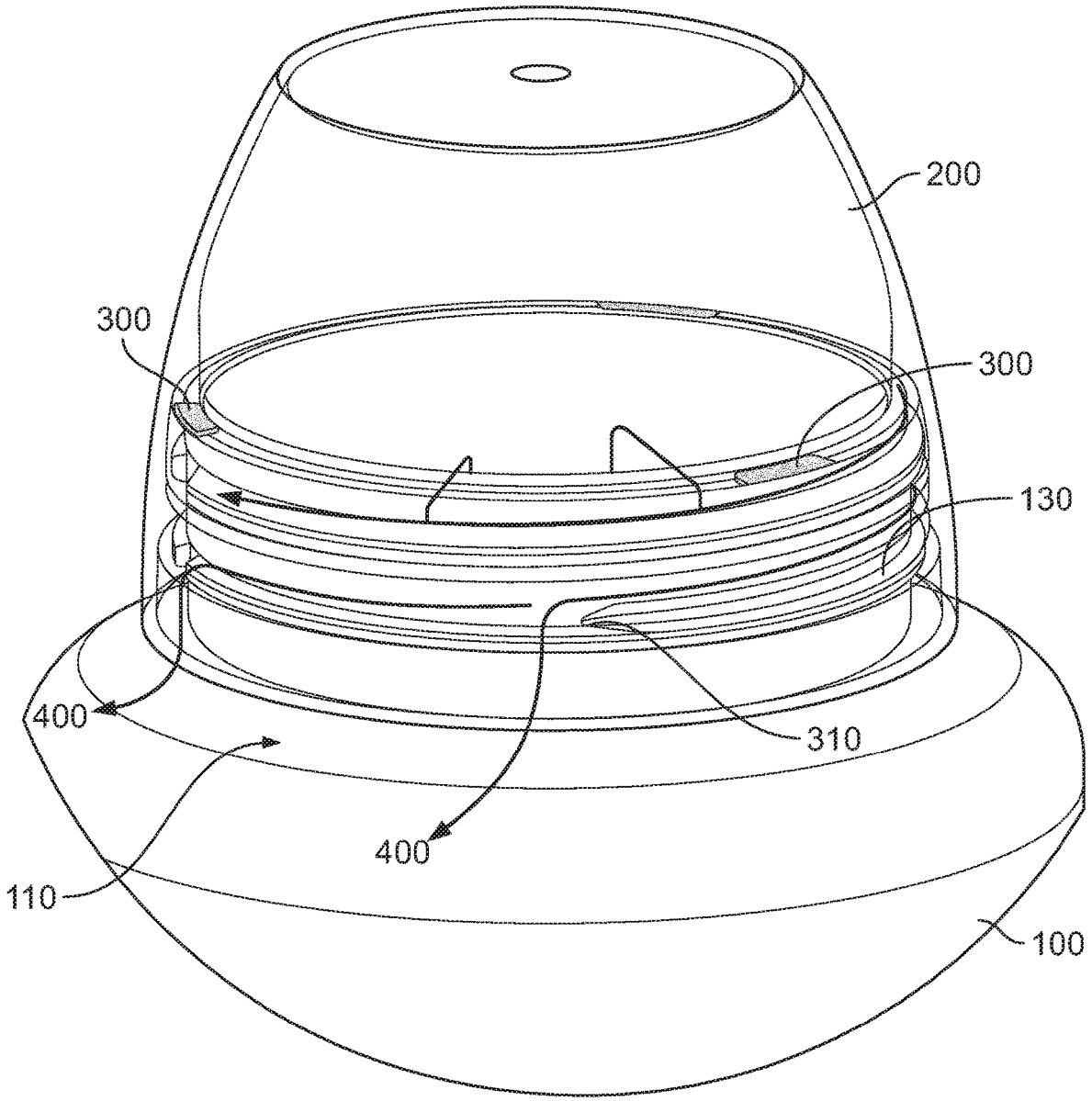
FIG. 2 is a partial perspective view of a top portion of a bottle and a cap in accordance with an embodiment of the invention.
Figure 3:
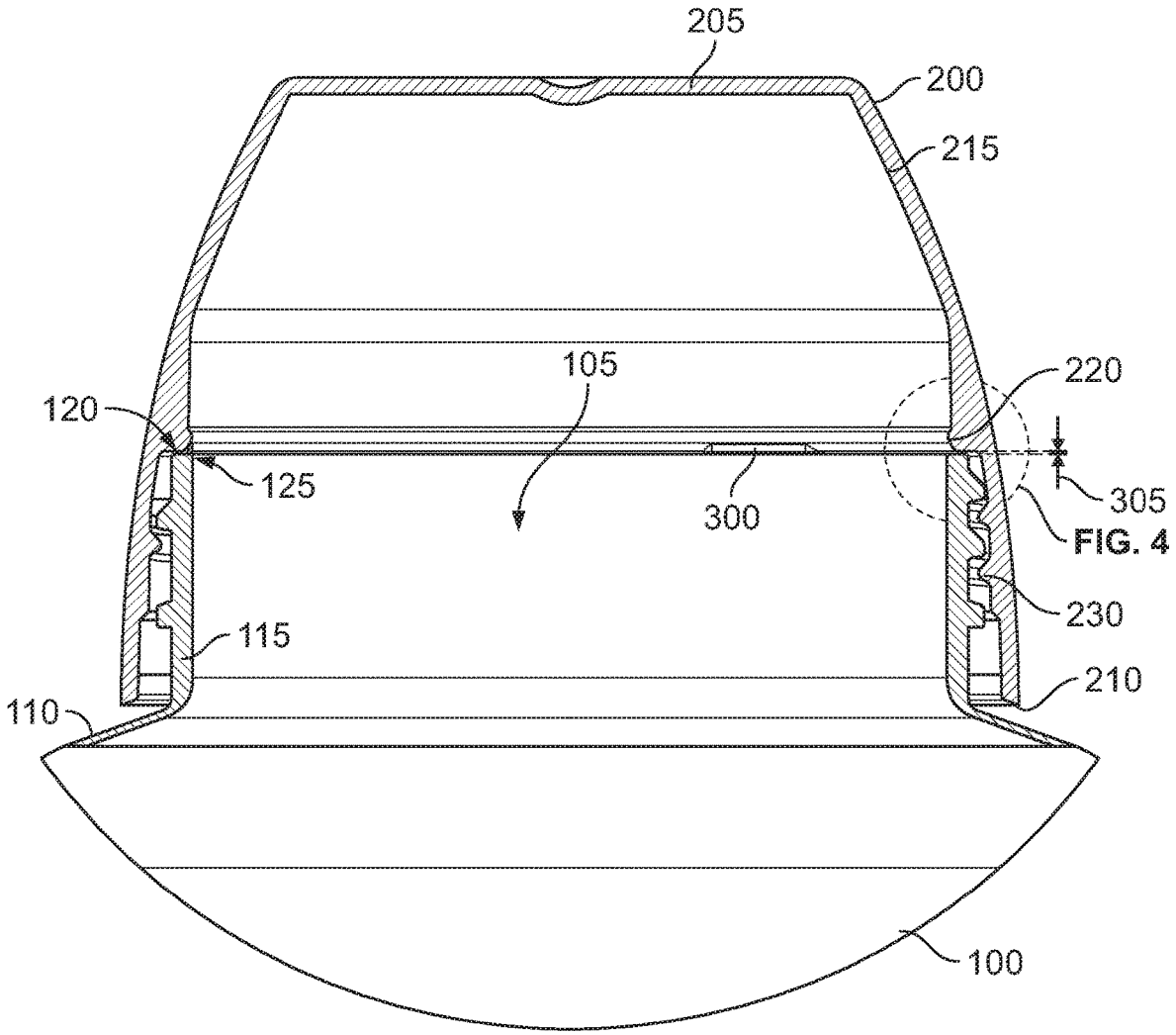
FIG. 3 is a sectional view of a top portion of a bottle and a cap in accordance with an embodiment of the invention.
Figure 4:
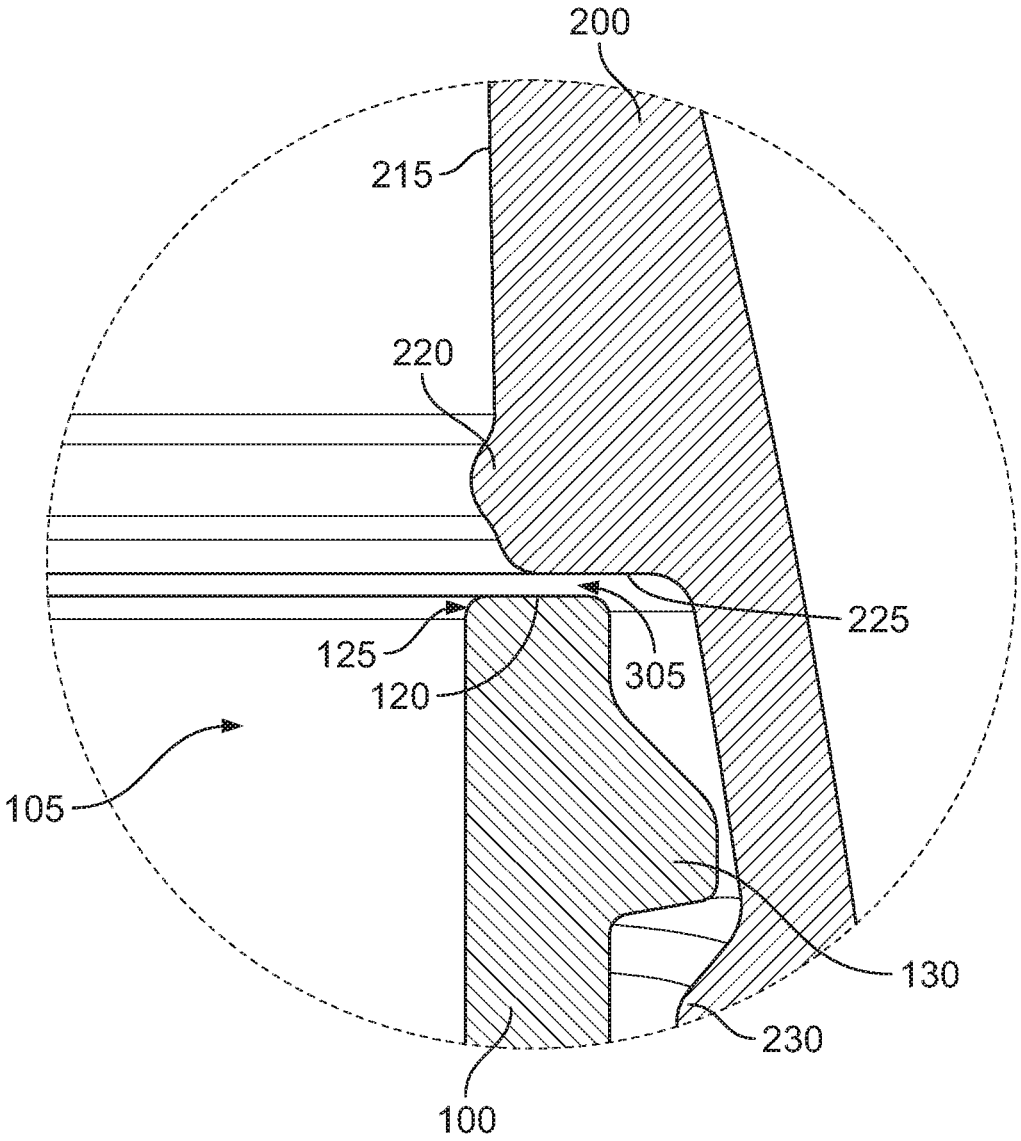
FIG. 4 is an enlarged section view taken of detail 4 from FIG. 3.
Figure 5:
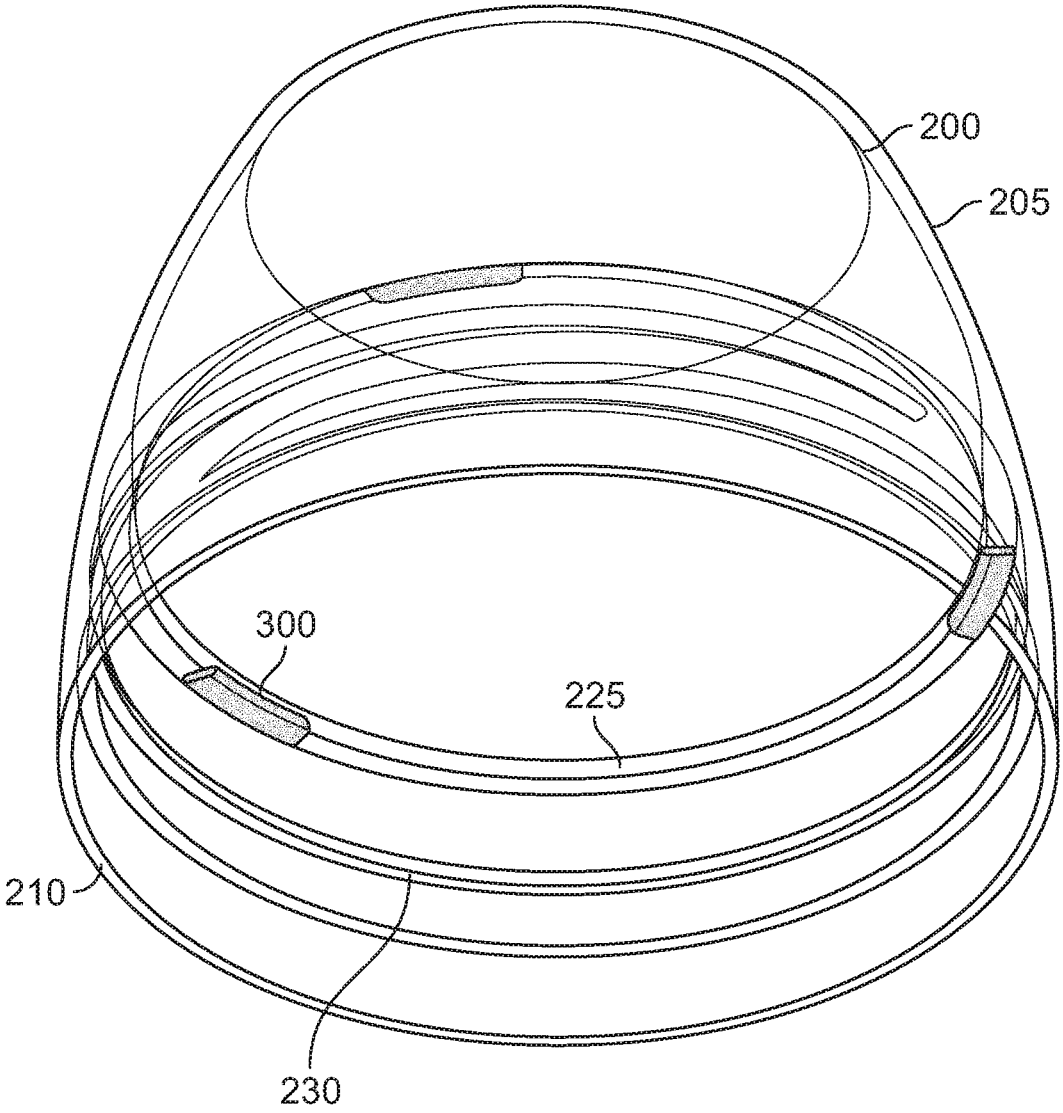
FIG. 5 is a perspective view of a cap in accordance with an embodiment of the invention.
Figure 6:
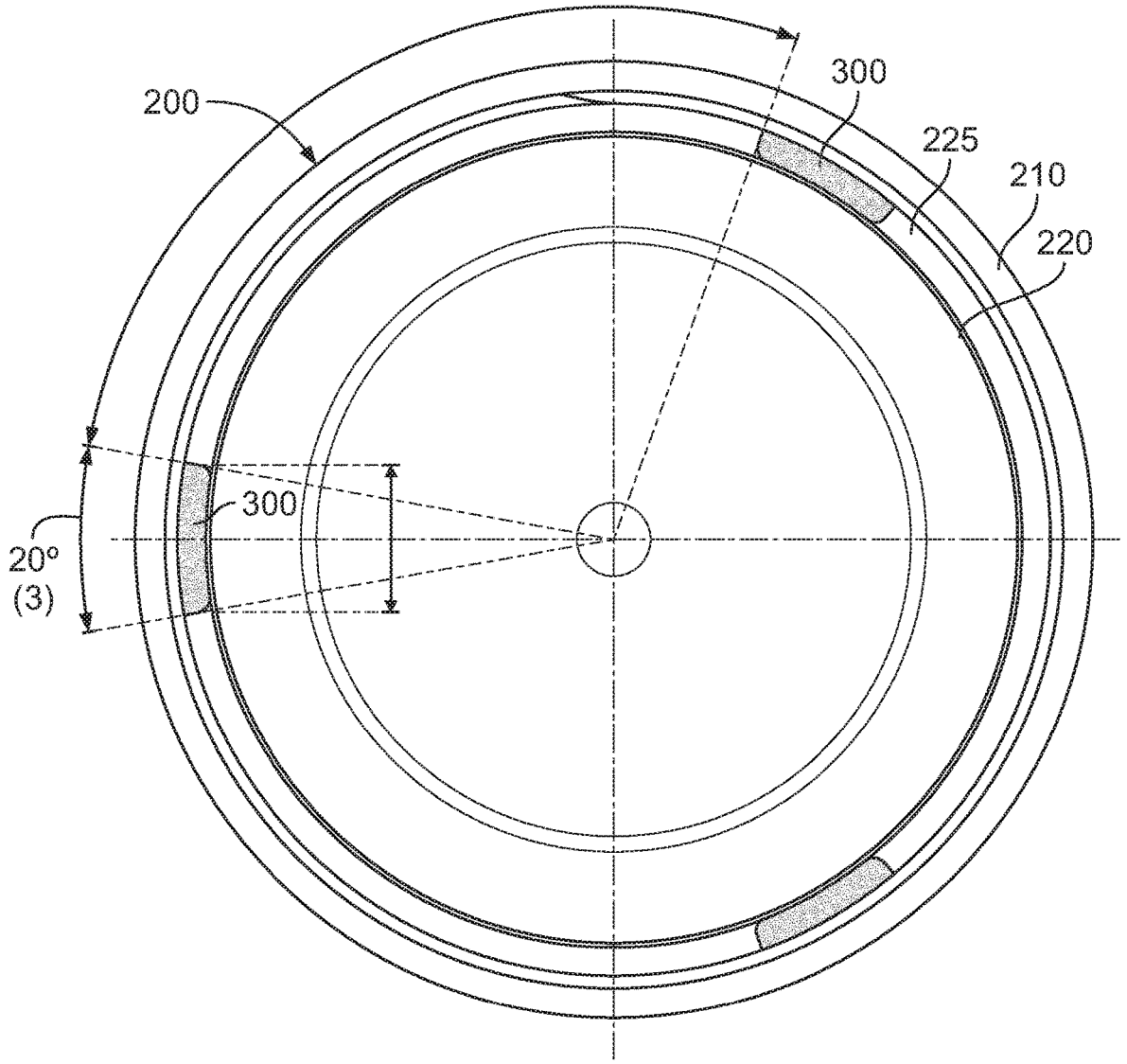
FIG. 6 is a bottom view of a cap in accordance with an embodiment of the invention.
Figure 7:
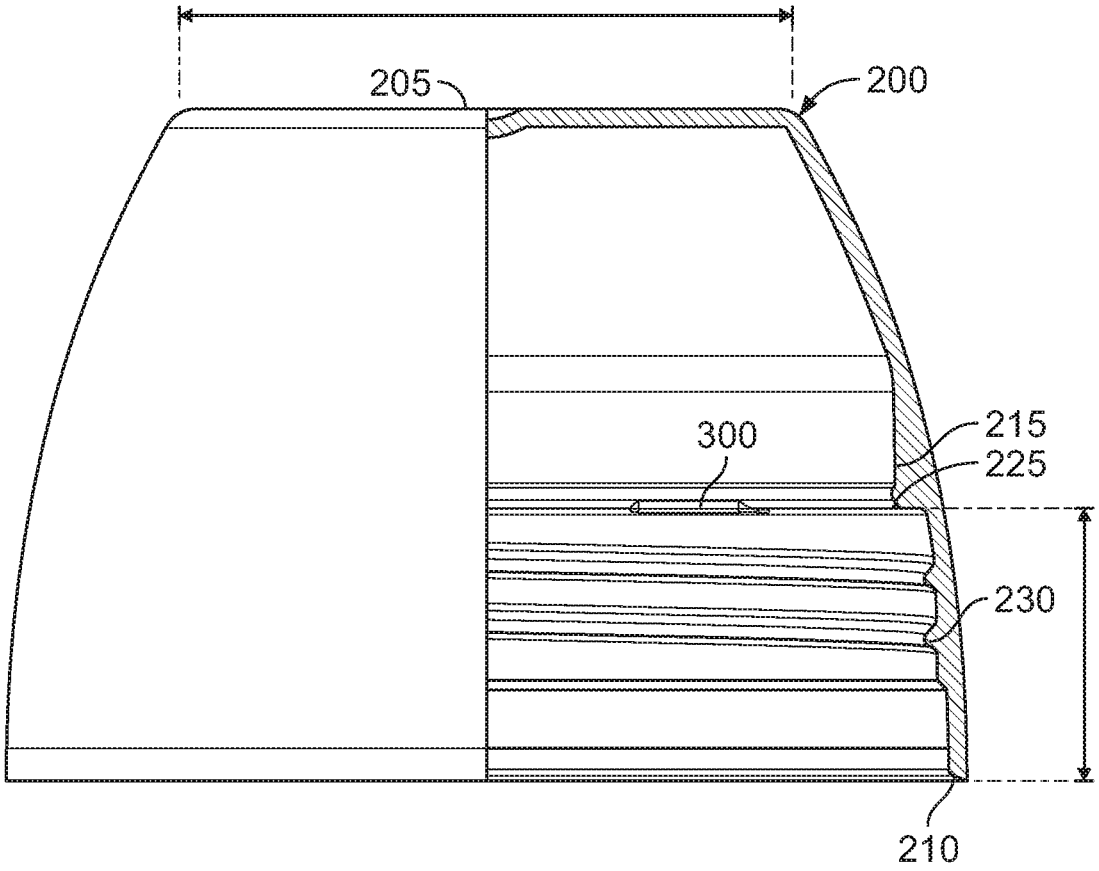
FIG. 7 is a partial sectional view of a cap in accordance with an embodiment of the invention.
Figure 8:
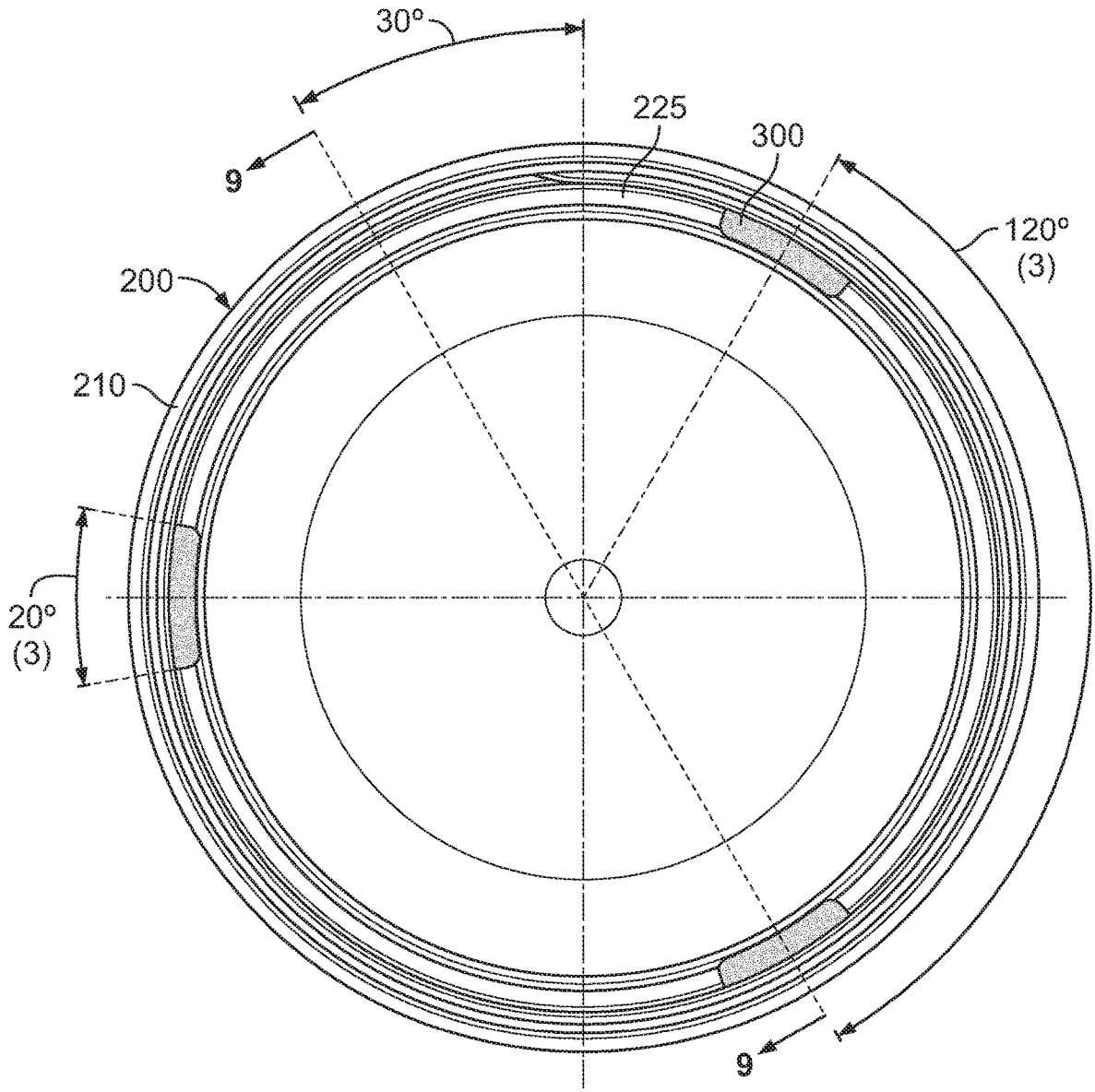
FIG. 8 is a bottom view of a cap in accordance with an embodiment of the invention.

Referring now to the figures, namely FIGS. 1 through 8, there is shown a bottle 100, partially shown, and a cap 200. The bottle 100 may be designed normally to include a base terminating into bottle sidewalls that extend upwardly to form a well 105 therebetween. The well is simply configured to hold a substance, such as a liquid or solid. In this particular invention the substance is more preferably a solid such as a powder, pellet or other small solid shaped product or portion thereof designed for a user to pour or retrieve from the well. The sidewalls of the bottle further extend into a shoulder section 110 that terminates into a neck 115. The neck includes an upper ledge 120 that surrounds an opening 125 into the well 105. The neck 115 includes outwardly extending neck threads 130.

The cap 200 is defined to include a top portion 205 terminating into a downwardly extending cap sidewalls 205 that terminate to into a bottom surface edge 210. An internal surface 215 of the cap sidewalls 205 includes a mid-section projection 220 that projects inwardly and includes an underneath side surface 225 and is configured to cooperatively engage with the upper ledge 120 of the bottle 110. The internal surface 215 below the mid-section projection 220 include cap threads 230 extending inwardly and configured to cooperate with the neck threads 130.

One or more raised pads 300 are positioned either on the top of the upper ledge 120 of the bottle 100 or on the underneath side surface 225 of the mid-section projection 220 of the cap 200. When the cap 200 is threaded onto the bottle 100, the raised pads 300 make contact with an opposing surface. The opposing surface is either defined as the upper ledge 120 when the raised pads 300 are positioned on the underneath side surface 225 or defined as the underneath side surface 225 when the raised pads 300 are positioned on the upper ledge 120. The contact between the raised pads 300 and the opposing surface creates a ventilation gap 305 between the two allowing for the scent or air to flow out of the bottle and over the upper ledge 120, between the upper ledge 120 and the mid-section projection 220. The raised pads 300 may be separately added or molded into the bottle or cap depending on its placement.

In another embodiment, the neck threads 130 further incorporate an interruption gap 135 dividing the neck threads 130 into thread segments 140. In this embodiment the scent can filter over the upper ledge 120 of the bottle 100, through the gap 135 between the thread segments 140, and under the bottom surface edge 210 of the cap 200.

If the interruption gap 135 is not included, the scent or air flow 400 follows the thread around the bottle neck and exits at an end 310 of the cooperative threads on the bottle and cap or elsewhere where appropriate gaps or clearances exist.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A bottle and cap package configured to hold a substance comprising:

a bottle having a neck extending from sidewalls that terminate into an upper ledge surrounding an opening into a well, wherein the well is configured to hold a substance, and the neck further including neck threads;

a cap defined to include a top portion terminating into a downwardly extending cap sidewall to create a dome over the bottle when the cap is secured to the bottle, the cap sidewall further terminating into a bottom surface edge, the cap sidewall has an internal surface to define into an upper internal surface and a lower internal surface with a mid-section projection projecting inwardly to define an underneath side surface between the upper and lower internal surfaces and the mid-section projection configured to cooperatively rest on the upper ledge of the bottle such that the dome has no contact with the upper ledge of the bottle, the lower internal surface further includes cap threads below the mid-section projection and extending inwardly to cooperate with the neck threads;

at least one raised pad positioned on the underneath side surface of the mid-section projection of the cap, and the at least one raised pad having a terminating edge along an edge of the mid-section projection and wherein the edge of the mid-section projection and the terminating edge of the at least one raised pad transition as a free edge directly into the upper internal surface such that when the cap is positioned on the neck of the bottle, the at least one raised pad creates a ventilation gap permitting a scent of a substance contained in the well of the bottle an escape path between the upper ledge of the bottle and the underneath side surface of the mid-section projection and then around the threads to under the bottom surface edge of the cap.

2. The bottle and cap package of claim 1, wherein the neck threads further include an interruption gap dividing the neck threads into thread segments, further providing the scent a path to flow through the interruption gap towards the bottom surface edge of the cap.

3. The bottle and cap package of claim 1, wherein the at least one raised pad is positioned onto the underneath side surface of the mid-section projection defined on the cap.

4. The bottle and cap package of claim 1, wherein the at least one raised pad is positioned onto the upper ledge of the neck defined on the bottle.

5. A bottle and cap package configured to hold a substance comprising:

a bottle having a neck extending from sidewalls that terminate into an upper ledge surrounding an opening into a well, wherein the well is configured to hold a substance, and the neck further including neck threads;

a cap defined to include a top portion terminating into a downwardly extending cap sidewalls, the cap sidewalls further terminating into a bottom surface edge, the cap sidewalls having an internal surface that has a mid-section projection projecting inwardly to define an underneath side surface configured to cooperatively rest on the upper ledge of the bottle, the internal surface further includes cap threads below the mid-section projection and extending inwardly to cooperate with the neck threads; and wherein the neck threads further include an interruption gap dividing the neck threads into thread segments, further providing the scent a path to flow through the interruption gap towards the bottom surface edge of the cap; and at least one raised pad positioned on the underneath side surface of the mid-section projection of the cap, and the at least one raised pad having a terminating edge along an edge of the mid-section projection and wherein the edge of the mid-section projection and the terminating edge of the at least one raised pad transition as a free edge directly into a portion of the internal surface such that when the cap is positioned on the neck of the bottle, the at least one raised pad creates a ventilation gap permitting a scent of a substance contained in the well of the bottle an escape path between the upper ledge of the bottle and the underneath side surface of the mid-section projection and then around the threads to under the bottom surface edge of the cap.

6. The bottle and cap package of claim 5, wherein the at least one raised pad is positioned onto the underneath side surface of the mid-section projection defined on the cap.

7. The bottle and cap package of claim 5, wherein the at least one raised pad is positioned onto the upper ledge of the neck defined on the bottle.

* * * * *